US006201342B1

(12) United States Patent
Hobart et al.

(10) Patent No.: US 6,201,342 B1
(45) Date of Patent: Mar. 13, 2001

(54) AUTOMATICALLY SHARP FIELD EMISSION CATHODES

(75) Inventors: Karl D. Hobart, Upper Marlboro; Francis J. Kub, Arnold, both of MD (US); Henry F. Gray, Alexandria, VA (US); Mark E. Twigg, Falls Church, VA (US); Phillip E. Thompson; Jonathan Shaw, both of Springfield, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/885,873

(22) Filed: Jun. 30, 1997

(51) Int. Cl.[7] ..... H01J 1/30
(52) U.S. Cl. ..... 313/309; 313/336; 313/351
(58) Field of Search ..... 313/309, 336, 313/351, 311, 312, 495, 308, 346 R; 427/255.6, 508, 521, 577, 578, 579, 249, 250, 255

(56) References Cited

U.S. PATENT DOCUMENTS

| | | | | |
|---|---|---|---|---|
| 5,341,063 | * | 8/1994 | Kumar | 313/309 |
| 5,475,280 | * | 12/1995 | Jones et al. | 313/309 |
| 5,627,427 | * | 5/1997 | Das et al. | 313/309 |
| 5,726,524 | * | 3/1998 | Debe | 313/309 |
| 5,783,905 | * | 7/1998 | Greschner et al. | 313/336 |

* cited by examiner

*Primary Examiner*—Nimeshkumar D. Patel
*Assistant Examiner*—Joseph Williams
(74) *Attorney, Agent, or Firm*—Barry A. Edelberg; George Kap

(57) ABSTRACT

An electron emitting device characterized by a monocrystalline substrate, a plurality of monocrystalline nanomesas or pillars disposed on the substrate in a spaced relationship and extending generally normally therefrom, monocrystalline self-assembled tips disposed on top of the nanomesas, and essentially atomically sharp apexes on the tips for field emitting electrons. A method for making the emitters is characterized by forming a gate electrode and gate electrode apertures before forming the tips on the nanomesas.

13 Claims, 3 Drawing Sheets

AUTOMATICALLY SHARP FIELD EMISSION CATHODES

BACKGROUND OF INVENTION

1. Field of Invention

The present invention relates to the field of electron field emission cold cathodes which have atomically sharp tips and to a fabrication method for making such cathode emitters by fabrication of the gate before the field emitters.

2. Description of Prior Art

Field emission sources require sharp electron emitter structures to create electric field enhancement which promotes electron emission from the tip of the field emitter. The very sharp structures that are required for field emission cathodes have been primarily fabricated by two approaches. The first approach typically starts with a silicon wafer and uses anisotropic crystallographic etching techniques or isotropic etching techniques in combination with oxidation sharpening to form sharp field emitters. A gate structure for modulating the emission current is fabricated after the tip is created. This approach suffers from nonuniform characteristics of the sharp tip due to nonuniform etching and oxidation processes which results in poor uniformity in the tips' radius of curvature.

The second approach uses selective deposition of metals to form conical shapes. In this approach, the gate electrode is formed prior to cathode fabrication. However, following emitter material deposition, this layer of material which exists over the gate electrode is removed from atop the gate electrode. Since the emitter is formed of polycrystalline material using this technique, each emitter tip is different due to random fluctuations of the size and shape of the polycrystallites that make up the field emitter which leads to nonuniformities in the electron emission characteristics.

The Kumar U.S. Pat. No. 5,341,063 discloses cold cathode field emitters comprising an electrically conducting metal layer with diamond field emission tips protruding above the metal. Kumar's fabrication includes the steps of coating a quartz or another substrate with a film of artificial diamond 50–500 nm thick preferably with (111) orientation with a plurality of diamond tips less than about 1 micron apart; depositing a conductive metal over the diamond layer; covering the diamond tips; and etching a portion of the conductive metal to expose the diamond tips with negative electron affinity material.

OBJECTS AND SUMMARY OF INVENTION

An object of this invention is a cold cathode electron emitter characterized by a plurality of nanomesas or high-aspect ratio submicron pillars disposed on a substrate each provided with an atomically sharp self-assembled tip.

Another object of this invention pertains to fabrication of a cold cathode field emitter comprising the steps of forming spaced nanomesas on a substrate, providing a gate around each nanomesa, depositing a semiconducting material on each nanomesa and growing tips by epitaxial self-assembly on the nanomesa having tip apexes with a radius of curvature on the order of 1 nm.

It is another object of this invention to fabricate a cold cathode field emitter by fabricating the gate before the tips so that sharpness of the tips is not compromised.

It is another object of this invention to fabricate tips by epitaxial techniques which produce tips with far better uniformity and significantly smoother surface morphology than either the oxidation process or deposition of polycrystalline material.

These and other objects of this invention are accomplished by a cold cathode field emitter and fabrication thereof. The field emitter is characterized by a multitude of nanomesas on a semiconductor substrate, tips of a semiconductor material disposed on the nanomesas with apexes of the tips of about 1 nm, and a gate around the upper portion of the nanomesas for extracting electrons by field emission from the tips such that these field emitted electrons travel to the anode. The fabrication process is characterized by growing the tips on the nanomesas by self-assembled epitaxy after formation of the gate.

BRIEF DESCRIPTION OF DRAWINGS

FIG. 2(*b*) schematically shows, after lift-off, a single nanomesa disposed on a substrate and dielectric and conductive layers on the substrate but not on the nanomesa;

DESCRIPTION OF PREFERRED EMBODIMENTS

The field emitter array of this invention includes a plurality of semiconducting nanomesas disposed on a semiconducting substrate, microscopic three-dimensional monocrystalline emitting regions or tips on the nanomesas of a semiconducting material each terminating in an apex, and a gate around the nanomesas to provide an extraction bias voltage for field emission such that the emitted electrons travel from the apexes of the tips to the anode when the field emitter is in operation. The gate is supported by a dielectric material disposed on the substrate. The fabrication process generally includes lithography and etching to form nanomesas disposed on a substrate, gate fabrication by directional or conformal deposition and etching, and tip formation by epitaxial self-assembly of semiconducting material deposited on the nanomesas which tips terminate in atomically sharp apexes.

The unique physical property of self-assembly by vapor phase epitaxial growth is used to create atomically sharp pyramidal semiconductor structures or tips for field emitter cathodes. The self-assembly process is on an atomic level where atoms arrange according to complex interactions between adatom kinetics and facet surface energy.

More specifically, the cold cathode field emitter of this invention includes a semiconducting monocrystalline substrate, a plurality of spaced nanomesas or pillars disposed on the substrate and extending thereabove generally perpendicularly to the substrate, a gate of an electrically conducting material spaced above the substrate arranged around and spaced from the nanomesas, a dielectric material disposed on the substrate and under the gate supporting the gate above and generally parallel to the substrate, and a tip of a semiconducting material disposed on the nanomesa and terminating in an apex. The apex of the tip is located generally at the middle of the vertical level of the gate.

Figure 1:
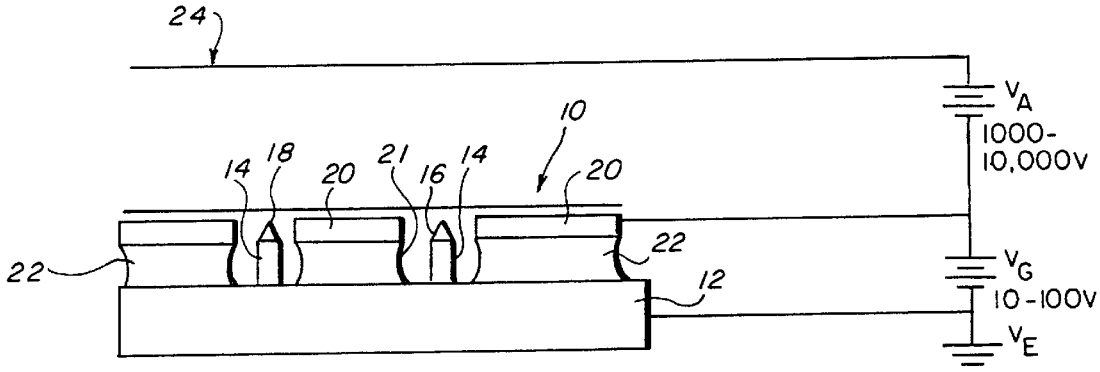
FIG. 1 schematically illustrates a portion of a field emitter characterized by a substrate, nanomesas or pillars disposed on the substrate, tips disposed on the nanomesas, and a gate around the upper portion of the nanomesas.

FIG. 1 illustrates a preferred embodiment of the present invention showing a partial view of a cold cathrode field emitter array 10, including a monocrystalline semiconducting substrate 12, a plurality of spaced semiconducting nanomesas 14 disposed on the substrate, semiconducting field emitter tips 16 disposed on the top surface of the nanomesas, apexes 18 which define atomically sharp terminations of the tips, electrically conducting gate 20 with openings 21 disposed around the nanomesa at about the middle of the vertical level of the apexes, dielectric support 22 disposed on the substrate underneath the gate adapted to support the gate at its vertical disposition, and anode 24 disposed above and generally parallel to the gate and above the apexes which emit electrons towards the anode when the field emitter is in operation. The nanomesas are typically circular in cross section, the tips of which are disposed within the openings in the gate at the upper portion thereof. The anode is a separate structure although it can be microfabricated integrally with the device.

Materials suitable for substrates, nanomesas and tips are those which are crystalline and can produce/form tips epitaxially by self-assembly with tips terminating in apexes sufficiently sharp for electron emission to take place under a sufficient voltage differential. Such materials have cubic or hexagonal crystal structures. Examples of such materials include silicon, carbon (diamond), gallium arsenide, indium phosphide, germanium, gallium phosphide, gallium nitride, silicon carbide, zinc carbide, cadmium sulfide, scandium, titanium, vanadium, chromium, manganese, iron, cobalt, nickel, copper, yttrium, zirconium, niobium molybdenum, ruthenium, rhodium, paladium, silver, hafnium, tantalum, tungsten, rhenium, osmium, iridium, platinum, gold, scandium oxide, vanadium silicide, manganese silicide, iron silicide, cobalt silicide, nickel silicide, tantalum oxide, tungsten carbide, tungsten rhenium, tungsten osmium, tantalum silicide, tantalum nitride, niobium silicide, molybdenum silicide, tin nitride, zirconium nitride, hafnium nitride, boron carbide, boron nitride, boron carbonitride, iron carbide, nickel aluminum, zirconium carbide, hafnium carbide, titanium dioxide, titanium nitride, vanadium oxide, chromium oxide and the like. Preferred materials for purposes herein include semiconducting elements and compounds of Groups III and V of the Periodic Table. Especially preferred materials for purposes herein include silicon, gallium arsenide, indium phosphide, germanium, gallium phosphide, gallium nitride, silicon carbide, zinc carbide, and cadmium sulfide, but particularly silicon and gallium arsenide.

In the embodiment shown in FIG. 1, the vertical extent of the nanomesa 14 is typically 0.1–2 $\mu$m, more typically about 0.7 $\mu$m; diameter or narrowest width of the nanomesa is typically 1–1000 nm, more typically about 100 nm; spacing between the nanomesas is typically 0.1–2 $\mu$m, more typically about 0.5 $\mu$m ; tip height above nanomesa is typically 20–200 nm, more typically about 60 nm; apexes 18 are typically less than or equal to 2 nm in size, more typically 1 nm or less; thickness of gate 20 is typically 0.1–1 $\mu$m, more typically 0.2–0.5 $\mu$m; thickness of gate support 22 depends on the thickness of the gate and the vertical extent of the nanomesas with which it is associated but it is typically 0.1–2 $\mu$m, more typically about 0.2–0.5 $\mu$m thick. The distance between a gate and a nanomesa should be generally small but it is typically 0.1–1 $\mu$m. Anode 24 is disposed above gate 20, typically 0.01–5 mm, more typically 0.1–2 mm thereabove.

FIG. 1 also illustrates schematically electrical connections between the anode, the gate, the substrate and field emitter. The voltage differential between the anode and the gate is typically 100–1,000 volts and between the gate and the substrate it is typically 10–100 volts.

Fabrication of the field emitter is characterized by forming the gate structure before the atomically sharp tips so that sharpness of the tip apexes is not compromised by the gate fabrication process. Fabrication of a cold cathode field emitter is commenced by coating a suitable semiconducting monocrystalline substrate with a resist. The resist is normally applied by spraying or by the spin process and its thickness is typically 0.5–1 $\mu$m. The resist is then irradiated or exposed to light by any patterning method, such as by means of a direct-write electron beam or through a mask by short wave length radiation, such as x-rays or ultraviolet rays, at spaced intervals to define the pattern of the nanomesas. Although e-beam lithography is typically used in such a situation, due to the known electron backscatter problem, x-ray lithography can be used to obtain a higher area density of field emitter tips. After exposure, resist is developed by, for example, a stirring action of the coated substrate in a developer solution typically for less than one-half hour thus removing the unwanted resist while leaving locations where the nanomesas will be formed covered with the resist.

In the formation of the nanomesas, the top unexposed surface free of the resist is anisotropically etched, for example, by a reactive ion etch process. This anisotropic etching, which typically takes less than one-half hour, removes some of the exposed substrate around the locations covered with the resist and forms the nanomesas covered with the resist. The next step is removal of the resist which is typically accomplished by subjecting it to an oxygen plasma, typically for about one quarter of an hour, during which time, the resist is removed by chemical and physical vaporization. Removal of the exposed resist from tops of the nanomesas can also be accomplished, for example, by washing the structure in a chemical solution by a wet chemical process.

The next stage is gate fabrication which can be accomplished by (1) directional or (2) conformal deposition. The directional process is generally characterized by physical deposition of a material in a high vacuum by evaporative deposition of the gate material. Direction of the deposition is perpendicular to the substrate surface. Conformal deposition is characterized by dissociation of a material and deposition thereof at atmospheric pressure or under vacuum. An example of conformal deposition is chemical vapor deposition (CVD).

Gate fabrication using the directional deposition is characterized by the formation of the gate and top of each nanomesa where the top of each nanomesa is located at about the middle of the vertical disposition of the gate. Thickness of the gate supports and the gate should be such that the nanomesa tops are properly positioned with respect to the gate.

Figure 2A:
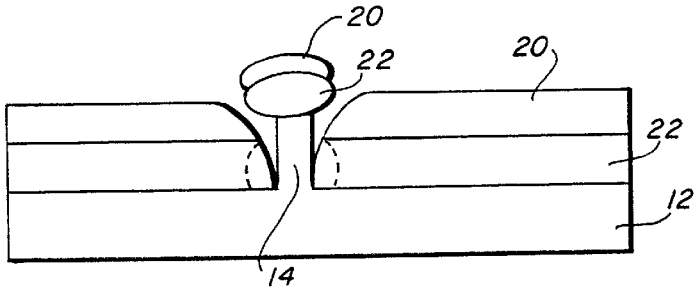
FIG. 2(*a*) schematically shows a single nanomesa disposed on a substrate and dielectric and conductive layers on the substrate and on the nanomesa before lift-off.
Figure 2B:
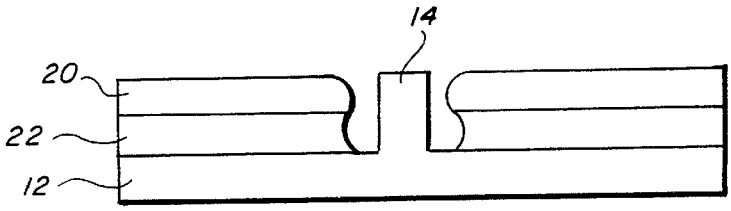
Figure 3A:
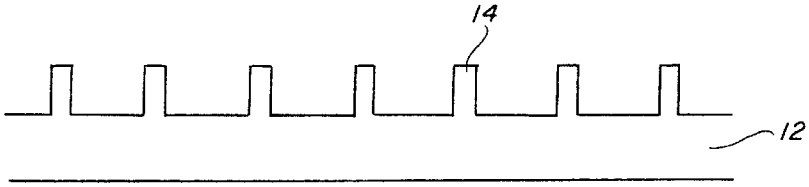
FIGS. 3(*a*) to 3(*e*) illustrate fabrication of the field emitter array by the conformal process.
Figure 3B:
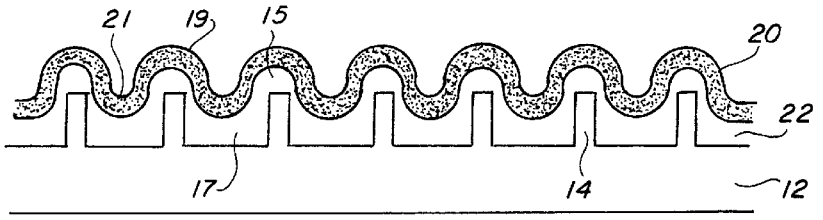
Figure 3C:
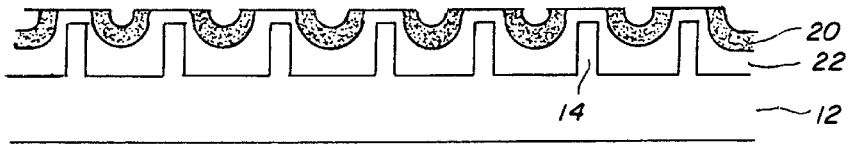
Figure 3D:
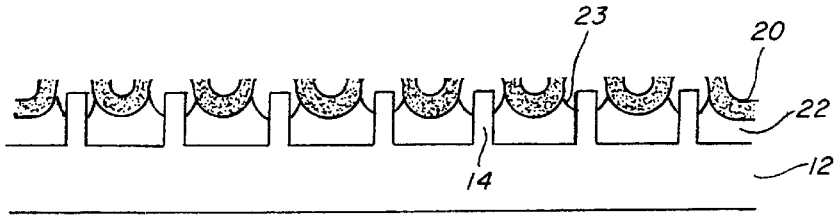
Figure 3E:
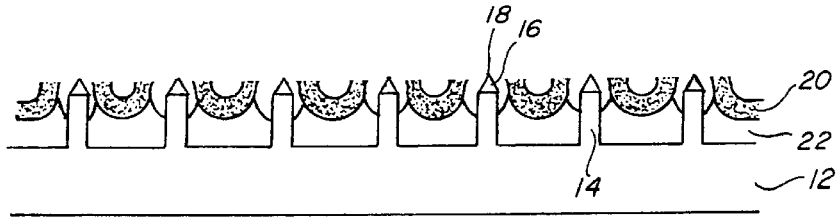

As shown in FIG. 2, directional gate deposition is preceded by directional deposition of a dielectric or an electrical insulator 22 of sufficient thickness to support the gate and electrically isolate the gate from the substrate. Suitable insulators or dielectrics include silica ($SiO_2$) and silicon nitride ($Si_3N_4$). Silica is typically used and deposition of silica generally takes about one half hour to deposit a layer about 0.5 $\mu$m thick. Such deposition results in a generally uniform layer of the insulator on the etched surface of the substrate and all around and on top of the nanomesas. Thickness of this layer is uniform on the substrate but uniformly diminishes around the nanomesas with the result that at the junction of the substrate and the nanomesas, thickness of the layer greatly diminishes to nearly nil. Also, the layer on top of the nanomesas is like a hemispherical or "mushroom" cap that has a larger diameter than the nanomesa diameter. The larger diameter of the cap causes a diminished deposition of the insulator around the nanomesa.

Deposition of insulator 22 is followed by perpendicular directional deposition of an electrically conductive layer 20 on top of the insulator layer which acts as a gate, as shown in FIG. 2(*a*). Examples of suitable conductive materials include doped polycrystalline silicon and metals, such as platinum, molybdenum, tungsten and chromium. For example, if polysilicon is used, its deposition generally takes about one hour to deposit a layer of about 0.3 $\mu$m thick after which, the polysilicon must be doped, typically by diffusion or ion-implantation with suitable elements, such as phosphorus and arsenic to make it electrically conducting. Such deposition results in a generally uniform layer 20 of the conducting layer on top of the insulator layer. However, due to the width or extent of the insulator caps on the nanomesas, deposition of the conductive layer 20 is removed, as by lift-off, from the nanomesas therearound and the insulator layer extends beyond the conductive layer albeit at uniformly declining thickness towards each nanomesa, as is shown in FIG. 2(*a*). The HF etch does not attack the conductive layer.

The conductive and the insulator layers are removed from top of each nanomesa by means of a selective etch, as by dipping the device for several minutes in hydrofluoric acid (HF). Since HF etches only the insulator and not the conductive material, what results is a lift-off whereby the tops of the nanomesas become free of both layers. Etching with HF not only results in lift-off of the conductive and the insulator layer from tops of the nanomesas but also it undercuts or etches away the exposed insulator layer around each nanomesa, as shown in FIG. 2(*b*).

Gate fabrication by the conformal deposition process also includes a number of steps which culminate in the formation of the gate. Each nanomesa top is located at about the middle of the gate opening or aperture with respect to the vertical disposition of the gate and centered radially within that gate aperture.

Pursuant to this process, conformal deposition of the insulator is made on a semiconducting substrate provided with a multitude of nanomesas arranged in a spaced arrangement on the substrate and projecting normal thereto, as shown in FIG. 3(*a*). Suitable dielectrics, as in the directional process, include silica ($SiO_2$) and silicon nitride ($Si_3N_4$). Silica is typically used. When silica is used as the dielectric insulator, the conformal layer thereof is typically about 0.1–2 $\mu$m uniformly thick extending over the etched surface of substrate 12 and over nanomesas 14 in a continuous form, as shown in FIG. 3(*b*) with crests 15 spaced over the nanomesas and valleys 17 between the nanomesas.

Conductive layer 20 is conformally deposited in a continuous layer on the insulator layer 22 in a generally uniform thickness and follows contour of insulator layer 22 with crests 19 directly above crests 15 of the insulator layer and valleys 21 above valleys 17 of the insulator layer, as is also shown in FIG. 3(*b*).

The next step in the conformal deposition process is planarization which involves removal of only crests 19 of the conductive layer along a horizontal plane but leaving crests of insulator layer 15 on nanomesas as well as remainder of the structure intact, as shown in FIG. 3(*c*). After planarization, as shown in FIG. 3(*c*), there is a continuous layer of insulator material 22 disposed on substrate 12 between nanomesas 14 with a continuous conductive layer 22 overlying the insulator layer with crests 19 removed over nanomesas 14. Remove of the desired amount of the conductive layer can be ascertained by either calibrating removal rate of the conductive layer or by resorting to a polish stop. Calibrating the removal rate can be accomplished by chemical-mechanical polish (CMP) using silica in an alkaline solution. The use of a polish stop to control removal of the conductive layer during planarization involves coating an adjacent surface to the substrate with a thin layer of a polish stop so that the upper surface of the polish stop is at the level of crest 15 of the insulating layer. Since the polish stop has a very slow polishing rate relative to the conductive layer, it serves to define extent of polishing the conductive layer and in this manner, serves to control extent of removal of the conductive layer above the nanomesas. Duration of the planarization can vary widely but can be done in about 10 minutes.

After planarization, the device is selectively etched to remove the insulator material around the upper portion of the nanomesas but retaining remainder of the structure intact, as is shown in FIG. 3(*d*). Selective etching can be accomplished, for example, with an HF isotropic etching solution for several minutes so that enough of the insulating layer is removed to have the device shown in FIG. 3(*d*).

After selective etching, the top of the nanomesas are disposed slightly below the top edge of gate 20, as shown in FIG. 3(*d*). Such relative disposition of the gate to nanomesas is referred to as self-aligned gate to nanomesas condition, which is also present in the directional gate deposition, as shown in FIG. 2.

Following gate fabrication by either (1) directional or (2) conformal deposition process, the self-assembled tip is formed. As shown in FIG. 3(*e*) and with greater detail in FIG. 4, nanomesa 14 is disposed on substrate 12 made of a semiconducting material. Nanomesa 14 may be of the same material as substrate 12 and the nanomesa may be part of the substrate. The tip, which may or may not be of the same material as the nanomesa, is disposed on the nanomesa by epitaxial self-assembled growth thereof by vapor phase epitaxial growth to form an atomically sharp apex. On top 26 of nanomesa 14 is an atomically sharp pyramidal semiconductor structure or pyramidal tip 16 formed by self-assembly with an atomically sharp apex 18. The pyramidal base of tip 16 is disposed on the circular top 26 of the nanomesa and the pyramidal base of the tip is coextensive with the circular top of the nanomesa. The base of the tip becomes essentially circular during growth thereof, as shown in FIG. 5.

Any deposition process of the tip material can be used which allows for epitaxial self-assembly of the tip. Such processes include but are not limited to molecular beam epitaxy, organometallic vapor phase epitaxy, metalorganic molecular beam epitaxy, plasma assisted molecular beam epitaxy, laser ablation, chemical vapor deposition, sputter deposition, reactive sputter deposition, liquid phase epitaxy and thermical beam deposition. In some instances, certain deposition processes, such as chemical vapor deposition, are of particular significance since they can be used in mass production of substrates or wafers.

For tip 16 to grow by self-assembly on top surface 26 of nanomesa 14 by using the molecular beam epitaxial deposition process (MBE), tip base diameter must be of a specified size; temperature of the nanomesa must be such which promotes self-assembly; deposition rate of the tip material must be such which promotes self-assembly;

vacuum in the growth chamber must be low, such as better than $10^{-7}$ Torr or even better than $10^{-8}$ Torr; and top surface of the nanomesas must be of such crystal plane which promotes self-assembly by non-planar growth topography.

Using the MBE process, if silicon is used as the substrate, and the nanomesas and the field emitter tips are also made of silicon, although they need not be, nanomesa diameter should be less than about 0.5 $\mu$m, preferably less than about 0.1 $\mu$m; nanomesa temperature should be 300–900° C., preferably 450–550° C.; and deposition rate should be less than 1 nm/sec, preferably 0.01–0.1 nm/sec.

With respect to non-planar topography, the crystalographic orientation of top surface of the substrate and top surface of the nanomesa must be of the character that promotes self-assembly. For most substrates, including silicon, crystallographic orientation of the top surface of the substrate and top surface of the nanomesa is Miller's Index (100) or any other plane which is conducive to self-assembly, such as (0001) for hexagonal crystals.

Figure 4:
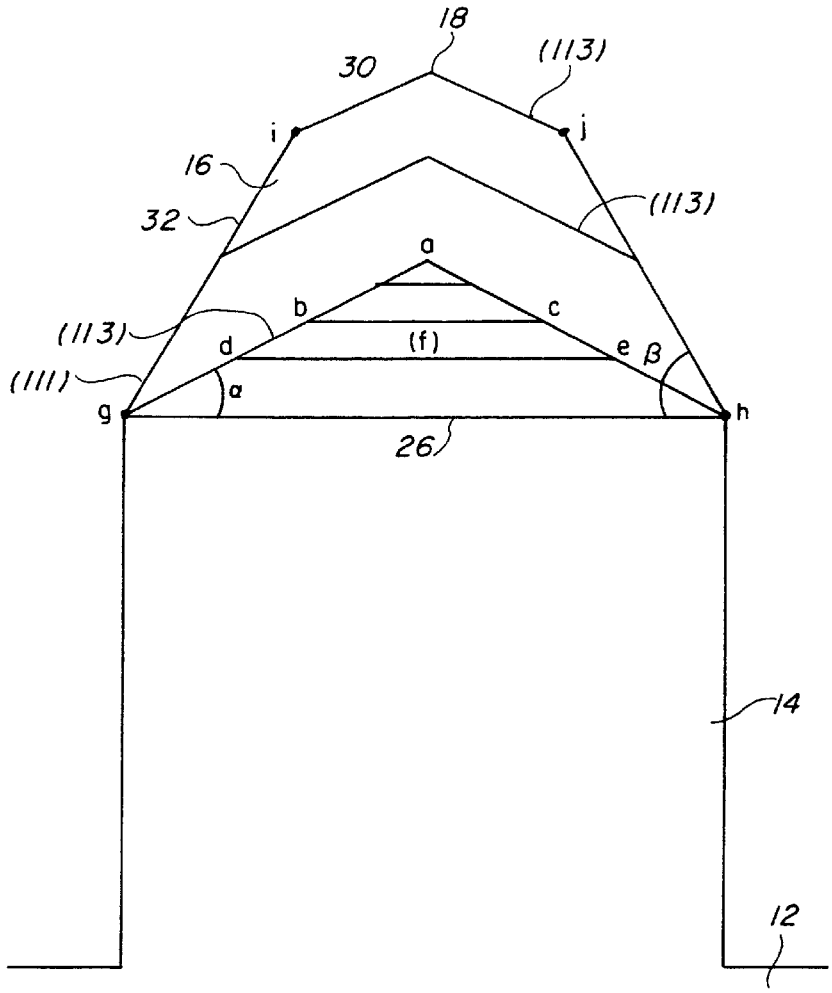
FIG. 4 is a schematic illustration of tip fabrication by epitaxial self-assembly.
Figure 5:
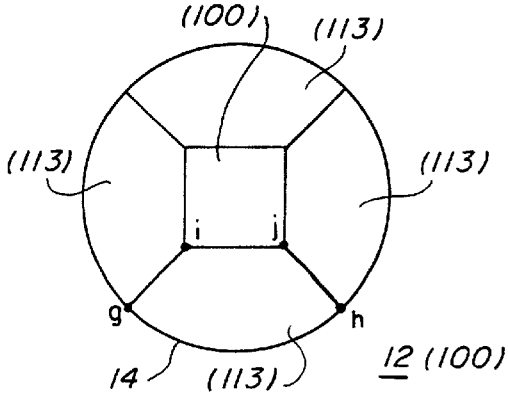
FIG. 5 is top or elevation view of FIG. 4 after deposition of an intermediate atomic layer of silicon before appearance of the (111) planes.

Epitaxial growth by self-assembly on silicon surface (100) on top surface 26 of nanomesa 14, is schematically illustrated in FIG. 4. As silicon is continuously deposited on top surface 26 which has (100) plane, silicon self-assembles by epitaxy and adatom kinetics in (113) four equivalent planes which grow upwardly with external planar surfaces inclined at an acute angle $\alpha$ of about 25° to the horizontal. This growth continues upwardly as more silicon is deposited with each atomic layer becoming narrower and narrower until a point is reached when epitaxial growth of planes (113) terminates in an apex.

It should be understood that during the tip growth process, although the pyramidal planes are (113), the top plane, as viewed from above, is (100). This is schematically illustrated in FIG. 5 which is the top or elevation view of tip fabrication after atomic layer (f) defined by points b, c, d, e in FIG. 4 has been deposited. As shown in FIG. 5, initial pyramidal planes are (113), the top of the tip plane is (100) as is the top surface of substrate 12 and the top 26 of nanomesa 14. Each side of the pyramid, such as side g-a, grows upwardly at an angle of about 25° until tip "a" is grown when growth of planes (113) stops. At this point in tip fabrication, the vertical distance from point "a" to top 26 of the nanomesa is approximately 20 nm for a nanomesa about 0.1 $\mu$m in diameter and about 0.7 $\mu$m in height.

After point "a" is reached and growth of the tip by means of planes (113) stops, another atomic layer of silicon is deposited on the pyramidal faces (113). Although what is deposited on the pyramidal faces continues to grow as (113) planes, what starts growing at the sides, at an angle $\beta$ of about 55°, are pyramidal planes (111), shown in FIG. 4. Growth rate of planes (111) is slower than that of planes (113) and growth rate of planes (113) is slower than that of planes (100). Growth of the (111) planes is continued until points i and j are reached when deposition of silicon is discontinued. When fabrication of the tip is terminated, the tip appears as shown in FIG. 4, where tip 16 is crowned by an atomically sharp apex 18 and is formed on the four sides by (113) planes 30 and (111) planes 32.

For a silicon substrate with a multitude of nanomesas about normal thereto with spacing between nanotresas of about 0.5 $\mu$m and with each nanomesa being about 0.7 $\mu$m high and about 0.1 $\mu$m in diameter, tip 16 is 100 nm wide with apex 18 of about 1 nm across. In such a scenario, vertical distance between points h and j in FIG. 4 is about 41 nm and vertical distance between points j and 18 is about 7.8 nm, making for a tip height above original nanomesa of about 48.8 nm.

If deposition of silicon is continued, the (111) planes would continue to grow until a tip is formed by the confluence of the four (111) pyramidal planes. In such an event, one would not see the (100) planes.

It should be understood that the tip can be made of a number of different materials. This can be done by first growing a layer of a first crystalline material on the nanomesa followed by other crystalline materials which would be grown by epitaxial self-assembly until a tip is formed of desired sharpness to serve as an electron emitter.

Tip sharpening formed by prior art techniques can be effected using epitaxial self-assembly, as described herein. Such tip sharpening can be effected by growing a monocrystalline material by epitaxial self-assembly on tips previously formed by a prior art technique, in which case, the previously formed tips serve as nanomesas. In such tip sharpening, growth of the monocrystalline material is continued until an apex is formed which is a product of epitaxial self-assembly.

It should also be understood that during formation of the tips by epitaxial self-assembly, as described, a layer of the monocrystalline semiconducting tip material forms on the gate. This layer is inconsequential since it does not appear to affect operation of the field emitter or device.

Tips formed by epitaxial self-assembly have a smoother surface morphology because of reduced number or absence of surface roughness, as evidenced by viewing the tips with the aid of a transmission electron microscope. Furthermore, field emitters with tips grown by epitaxial self-assembly have better uniformity as evidenced by current scale-up with number of tips in a field emitter or device.

The tips can be protected in many ways. Since tips are fabricated last, options for tip protection include adsorption treatment with atomic hydrogen to passivate the silicon surface and prevent oxidation thereof (e.g., hydrogen layer of 1.3 Å), deposition of a very thin (about 6 Å, for example) layer of germanium, and deposition of chemically stable materials to improve emission characteristics. Germanium layer that is deposited on the tips forms a water-soluble germanium oxide that can be removed by either a water rinse or field-desorption during initial stages of device operation. Examples of chemically stable materials that can improve emission characteristics include diamond and gallium nitride.

Tips formed as described herein can be a template for other materials. Tips can be made for operation at a lower gate voltage by the incorporation or surface application of a lower work function material on the surface of the tips. Incorporation can be effected by evaporation, epitaxial growth or CVD. Examples of such materials include barium, cesium, cesium oxide, barium oxide, copper oxide, sodium, sodium compounds, mixtures thereof, and the like. Thickness of such a material when applied to the surface of the tips is typically in the range of 1 to 1,000 nm.

While presently preferred embodiments have been shown of the invention disclosed herein, persons skilled in this art will readily appreciate that various additional changes and modifications may be made without departing from the spirit of the invention as defined and differentiated by the following claims.

What is claimed is:

1. A cold cathode electron emitting device comprising a monocrystalline substrate, a plurality of monocrystalline nanomesas disposed on said substrate, epitaxial self-assembled tips disposed on said nanomesas, and apexes on said tips for emitting electrons.

2. The device of claim 1 wherein vertical extent of a said nanomesas is 0.1–2 $\mu$m; diameter of said nanomesas 1–1000 nm; spacing between said nanomesas is 0.1–2 $\mu$m; and tip height is 20–200 nm; said tips have a generally pyramidal construction and said apexes are atomically sharp.

3. The device of claim 2 wherein top surface of said nanomesas has the same crystal plane as the top surface of said substrate, said crystal plane being conducive to epitaxial self-assembly of said tips.

4. The device of claim 2 wherein top surface of said nanomesas and top surface of said substrate have Miller Index of (100) crystal plane and wherein said tips are defined by crystal planes (111) and (113).

5. The device of claim 2 including a layer of a low work function material on the surface of said tips.

6. The device of claim 4 wherein said apexes are about 1 nm and said substrate, said nanomesas, and said tips are made of a monocrystalline semiconducting material selected from the group consisting of silicon, gallium arsenide, indium phosphide, germanium, gallium phosphide, gallium nitride, silicon carbide, zinc sulfide, and cadmium sulfide.

7. The device of claim 6 wherein vertical extent of said nanomesas is about 0.7 $\mu$m; diameter of said nanomesas is about 100 nm; spacing between said nanomesas is about 0.5 $\mu$m; and said substrate, said nanomesas, and said tips are made of silicon.

8. The device of claim 6 including an electrically conducting gate electrode with openings for said nanomesas.

9. The device of claim 8 including a dielectric support for said gate electrode and an anode disposed above said gate electrode, said gate electrode is 0.1–1 $\mu$m thick with said tips disposed in said openings.

10. The device of claim 9 wherein said tips are disposed in a vacuum of $10^{-7}$ Torr or lower.

11. The device of claim 4 including a passivating layer on said tips.

12. The device of claim 11 wherein said passivating layer is selected from the group consisting hydrogen, germanium, and a chemically stable material.

13. The device of claim 4 wherein said tips comprise a layer of at least two different monocrystalline semiconductive materials.

* * * * *